US007997580B2

(12) United States Patent
Luciano, Jr.

(10) Patent No.: US 7,997,580 B2
(45) **Date of Patent: *Aug. 16, 2011**

(54) VARIABLY BOUND SECONDARY GAME METHOD

(75) Inventor: Robert A. Luciano, Jr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/504,041

(22) Filed: Jul. 16, 2009

(65) Prior Publication Data

US 2009/0280893 A1 Nov. 12, 2009

Related U.S. Application Data

(63) Continuation of application No. 10/256,024, filed on Sep. 26, 2002, now Pat. No. 7,562,873.

(60) Provisional application No. 60/325,813, filed on Sep. 28, 2001.

(51) Int. Cl.
*A63F 1/18* (2006.01)

(52) U.S. Cl. ..... 273/139; 273/142; 463/21; 463/25

(58) Field of Classification Search ..... 463/16–22, 463/25–27; 273/138.1, 139, 142 R, 143 A, 273/143 B, 138.2, 138.3
See application file for complete search history.

(56) References Cited

U.S. PATENT DOCUMENTS 6,537,150 B1 * 3/2003 Luciano et al. ..... 463/16
6,569,015 B1 * 5/2003 Baerlocher et al. ..... 463/16

* cited by examiner

*Primary Examiner* — Dmitry Suhol
*Assistant Examiner* — Alex F. R. P. Rada, II
(74) *Attorney, Agent, or Firm* — Marvin A. Hein

(57) ABSTRACT

The present invention provides new player excitement during the play of a game of chance by providing a controlled random event during the execution of a secondary or bonus round. When bonus game play is invoked during play of the primary game, an amount to be issued during secondary game play is generated. This amount is not awarded directly; instead a plurality of possible winnings is available, each equal to or less than the amount to be issued. A random event separate from the primary game is used to pick one of the plurality of possible winnings which is awarded to a player. The separate random event may be a mechanical event or an electronic event. The difference between the amount given to a player and the original amount to be issued may be used to generate further bonus game play, or may be used to fund a progressive.

12 Claims, 7 Drawing Sheets

Further Exemplars Of Secondary Games According To The Present Invention

VARIABLY BOUND SECONDARY GAME METHOD

RELATED APPLICATIONS

This application is a continuation of U.S. application Ser. No. 10/256,024 filed on Sep. 26, 2002, which claims the benefit of the filing date of provisional application 60/325,813 filed on Sep. 28, 2001, entitled "System And Method For Operating Games Of Chance", both applications hereby explicitly incorporated by reference in their entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

This invention pertains generally to enhanced methods of operating games of chance. More particularly, the invention is a method of operating primary and secondary (or bonus) games wherein the outcome of the secondary game, while determined partially by chance, is bound by results from either a primary game or from an initial determination of an award or prize amount on the secondary or bonus game.

2. Description of the Related Art

Gaming devices of various types have been in use for many years. The most common type is the conventional slot. A player operates a slot machine by providing coin or paper monies that are received as game credits towards playing a game (i.e., placing wagers) on the slot machine. Some machines allow a user to provide game credits in the form of a voucher, a printed coupon or a data card (e.g. magnetic strip or smart card). Once the sufficient amount of game credits has been provided to constitute a wager, the player then initiates the game, normally by pulling a handle or activating a button. If a winning event occurs pursuant to the game, the slot machine issues a winning amount according to the player's wager and to a predetermined pay scheme. The game results are generally based on randomly generated events, or may be based on a random draw from a fixed pool of results (e.g., video lottery pool). The winning amount issued to the user is provided by a corresponding amount of game credits, which the player may redeem (cash-out) or use for further play on the slot machine. Similar game play and award schemes are provided according to other gaming devices such as video poker machines and keno machines.

Secondary (bonus) awards have been introduced as improvements to conventional gaming devices to entice increased game play and income for casinos. For example, a common bonus scheme is to award a player a chance to multiply his award winnings pursuant to a secondary or bonus stage of the game. Most bonus awards are simply an increased multiple of the primary winnings and are issued as game credits suitable for redemption or further play of the gaming device. Traditionally, secondary bonus games are implemented on the same gaming apparatus or housing as the primary game, sometimes sharing the same video display, or otherwise integrated as a "top box" to the primary gaming device.

When the secondary bonus round is reached during play of the primary game, the bonus award is predetermined by a random process, after which the bonus award is displayed and paid to the player. The display may appear to be randomly generated at the time, but in reality the display is controlled to display the bonus award previously determined by the random process. While this implementation provides various means for displaying the selected bonus award, the implementation is nevertheless limited to displaying the actually predetermined bonus award and paying out that amount to the player. As a result, players who are cognizant of this process become disinterested in the secondary bonus round of play, thereby reducing the overall game play and revenue for the gaming operator.

What is needed is a way of managing the operation of the game of chance so that the secondary game process is bound by the predetermined secondary award while providing flexibility and randomness, within predetermined bounds, of the secondary game payout. As will be described more fully below, such an arrangement expands the available means for awarding and displaying a secondary bonus award.

SUMMARY OF THE INVENTION

To satisfy these needs as well as other deficiencies found in the prior art, disclosed herein is a system and method for operating a game of chance having a primary game and secondary game where the secondary award payout paid by the secondary game to the player is bound by, but not limited in equality to, the predetermined secondary award determination. The present invention provides for the generation of a remainder portion comprising the difference between a secondary award payout and the award determination, which may then be paid out in a variety of ways as described below.

According to one embodiment, the secondary game comprises an analog non-controlled display element. One example of an analog non-controlled display element is a mechanical wheel having a plurality of prize slots and a movable ball indicator (similar to a lottery wheel) to indicate one of the prize slots. The ball, however, is bound within a range of two or more prize slots while the wheel is spinning and when the wheel comes to rest. For example, a barrier may be used to restrict the possible area for the ball to travel so that the ball can only come to rest within a desired range or boundary. Under this arrangement, the ball may be permitted to rest within a designated range of prize slots, each of which are less than or equal to the designated award prize. Accordingly, additional game play diversity is provided to the player since the actual payout may vary depending on which particular prize slot the ball comes to rest. Other secondary game arrangements using analog elements are equally suitable and would benefit from the present invention.

In other embodiments, the secondary game need not require the use of analog components to realize the benefits of the invention. For example, the secondary game may simply include a random number generator (RNG) electronically executed by a processor. The present invention would allow the RNG to generate a secondary prize award payout within the bounds already established by the predetermined secondary award determination. The award payout may then be indicated to the player using various means, whether via video display or using electromechanical displays (e.g., reels, wheels, touch screens with prize amounts being made visible to a player upon a player touching a specific picture on the screen, etc).

Unlike prior art implementations requiring the payout to equal the predetermined secondary award determination, the present invention defines the range of possible outcomes using the predetermined secondary award amount, usually as a maximum value. The value generated by the RNG would thus be bound by the predetermined secondary award amount, but will typically produce an award payout different from predetermined secondary award determination.

As described above, the predetermined secondary award amount may provide an upper limit for the actual payout to be awarded to the player. In yet another embodiment of the present invention, the predetermined secondary award amount will actually be two amounts that comprise both an upper and lower limit, so that the actual payout to be awarded to the player is greater than or equal to the lower limit and less than or equal to the upper limit.

Although described in the context of traditional Nevada-style games of chance being the primary game, it is fully contemplated that the present invention can also be used where the primary game is a combination of skill and chance, as well as with primary games of skill. Games of skill would typically be found in arcade type games where both primary and secondary games would usually be on site, or alternatively the primary games will run on home PCs where the secondary game would be at a common site and communicating with the primary game over a network or the internet. The latter case is one embodiment of a shared secondary game, discussed more fully below.

The invention further relates to machine readable media on which are stored embodiments of the present invention. It is contemplated that any media suitable for retrieving instructions is within the scope of the present invention. By way of example, such media may take the form of magnetic, optical, or semiconductor media. The invention also relates to data structures that contain embodiments of the present invention, and to the transmission of data structures containing embodiments of the present invention.

Further objects and advantages of the invention will be brought out in the following portions of the specification, wherein the detailed description is for the purpose of fully disclosing the preferred embodiment of the invention without placing limitations on varying embodiments having the core of the invention thereon.

BRIEF DESCRIPTION OF THE DRAWINGS

The present invention will be more fully understood by reference to the following drawings, which are for illustrative purposes only

DETAILED DESCRIPTION OF THE INVENTION

Persons of ordinary skill in the art will realize that the following description of the present invention is illustrative only and not in any way limiting. Other embodiments of the invention will readily suggest themselves to such skilled persons having the benefit of this disclosure.

Figure 3:
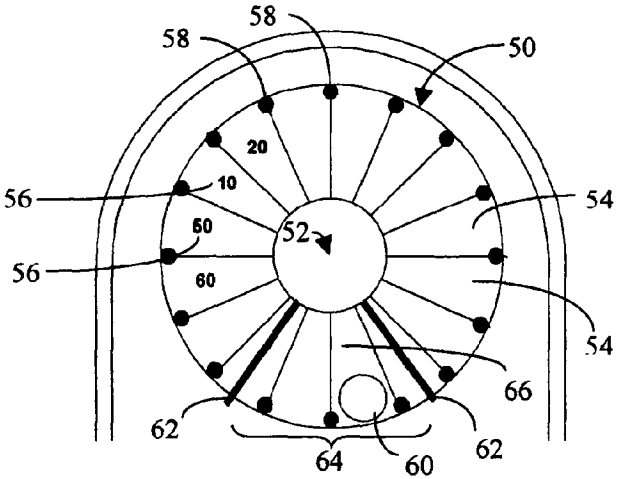
FIG. 3 illustrates an example secondary wheel apparatus suitable for use with the present invention.
Figure 4:
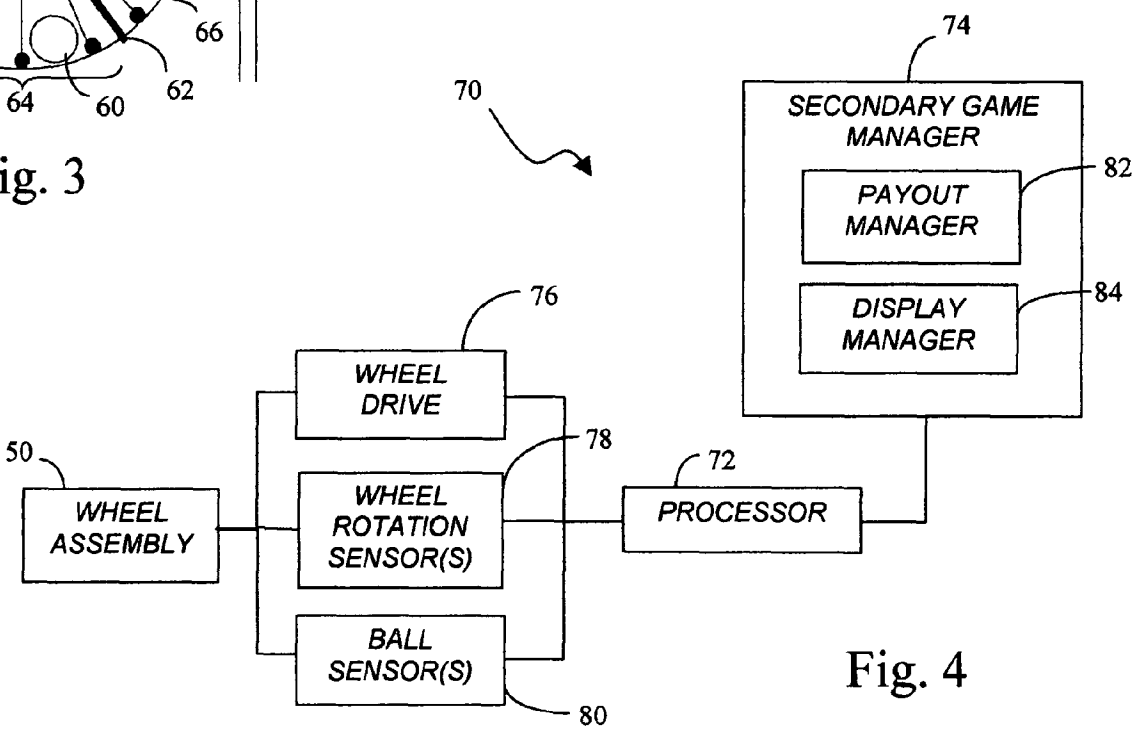
FIG. 4 is a functional block diagram of a secondary game system suitable for use with the example wheel apparatus of FIG. 3 in accordance with the present invention.
Figure 5:
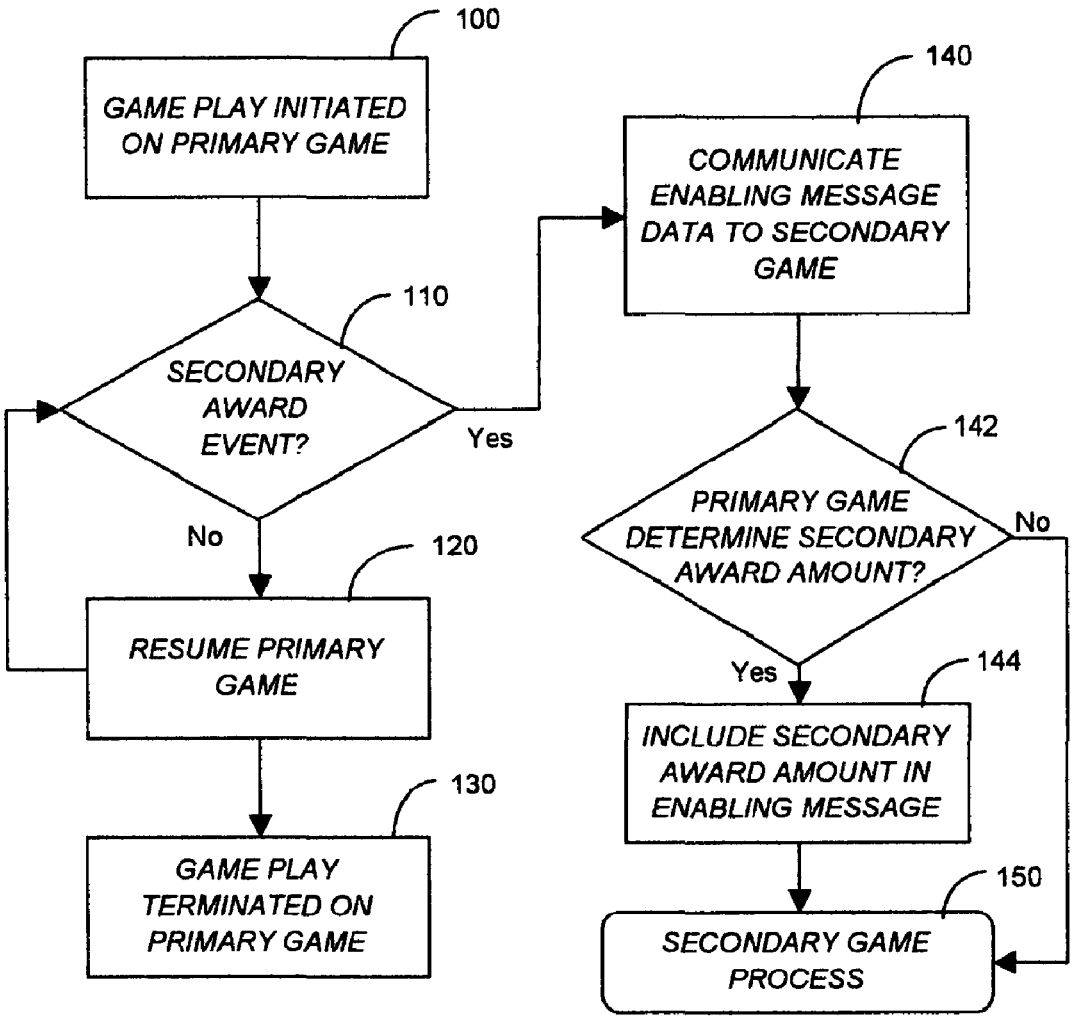
FIG. 5 is a logical flow diagram of the operation of the primary game in accordance with the present invention.
Figure 7:
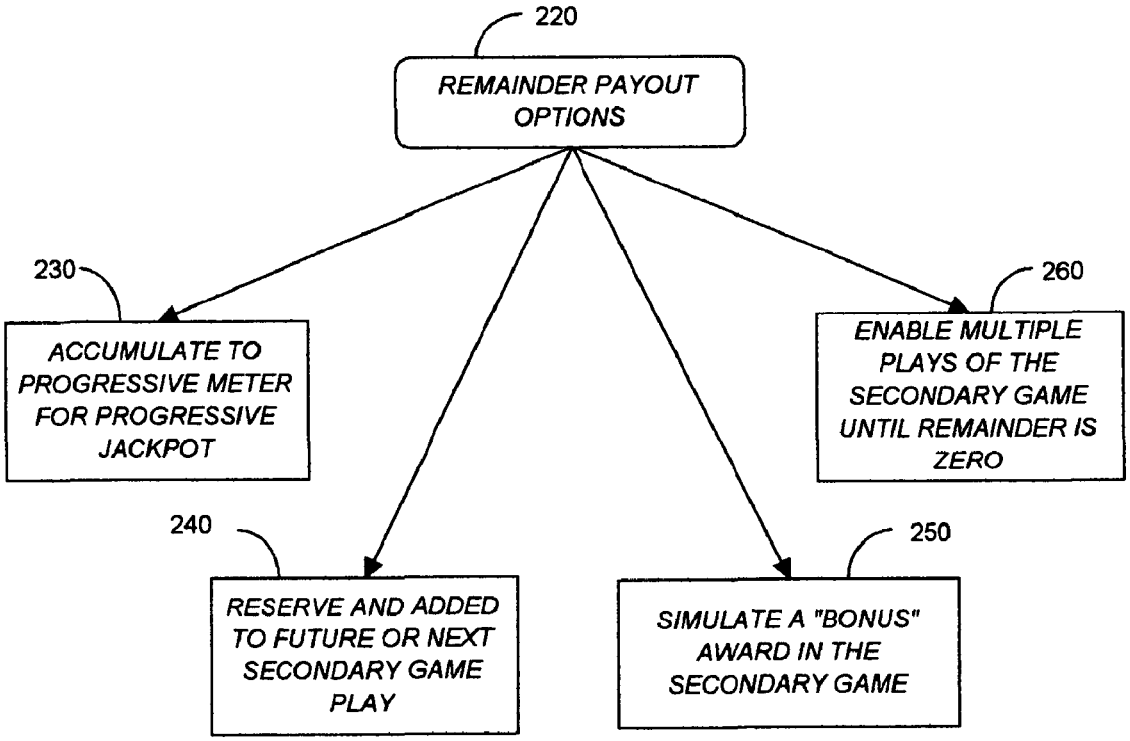
FIG. 7 is a logical flow diagram of the remainder payout options in accordance with the present invention.

Referring more specifically to the drawings, for illustrative purposes the present invention is embodied in the apparatus shown in FIG. 1 through FIG. 4 and FIG. 8, and the methods outlined in FIG. 5 though FIG. 7. It will be appreciated that the apparatus may vary as to configuration and as to detail of the parts, and that the method may vary as to details and the order of the acts, without departing from the inventive concepts disclosed herein.

Figure 1:
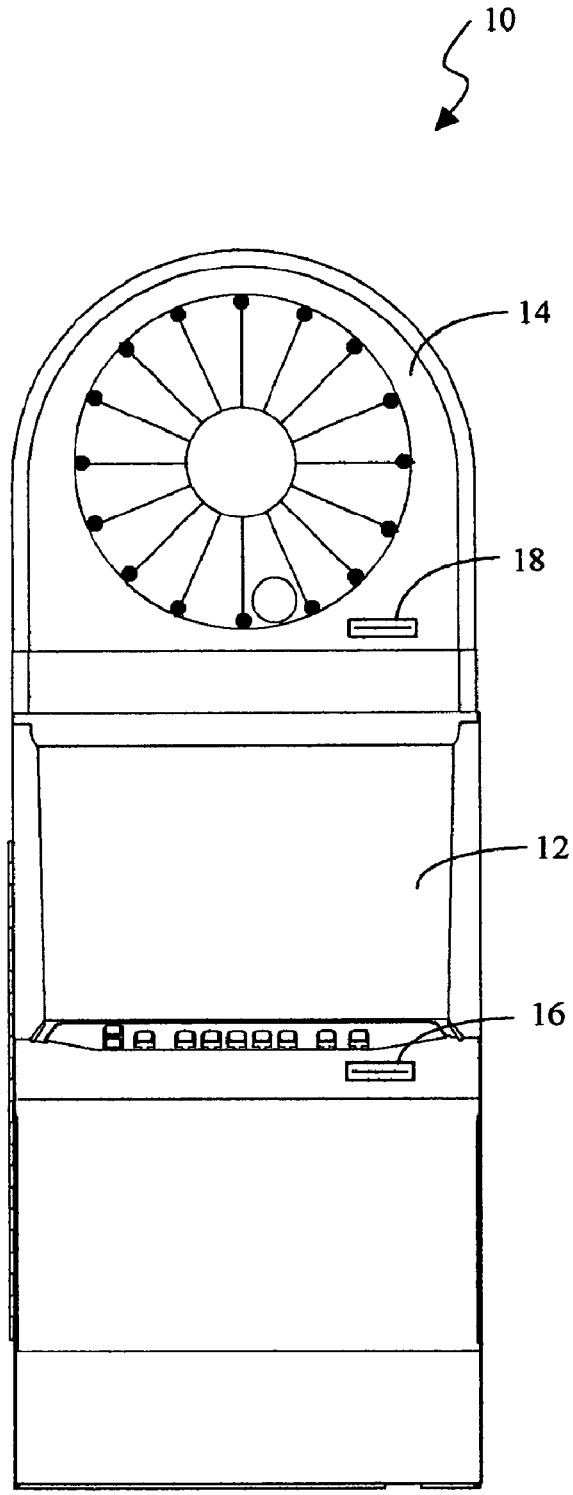
FIG. 1 illustrates an example embodiment gaming apparatus including a primary game integral with a secondary game suitable for use with the present invention.

Referring first to FIG. 1, there is shown an example gaming apparatus 10 including a primary game 12 integral with a secondary game 14 suitable for use with the present invention. The primary game 12 of FIG. 1 comprises a conventional game of chance, such as a slot machine, video poker machine, keno machine, video lottery terminal, bingo, or other game of chance. Thus primary game 12 comprises conventional hardware and software components suitable for executing the game of chance. Games of chance typically require such hardware as a processor for carrying out game instructions, memory for storage and retrieval of game instructions and game data, and input/output (I/O) devices for communicating game information to the player. I/O devices such as video displays, electromechanical displays, player buttons, speakers, lights, coin and/or bill acceptors and dispensers, player tracking devices, and network communication devices are common and are included on most primary games of chance machines. The game software is normally provided on memory (e.g., EEPROM, CD-ROM, removable media, network media) which is loaded to and executed by the processor during operation.

The secondary game 14 may be any secondary or bonus stage game, although the example gaming apparatus 10 includes a secondary "bonus wheel" game, which is described in more detail below in conjunction with FIG. 3. In some embodiments, such as the use of a touch screen where a player picks from a choice of selectable spots as indicated by game symbols (typically pictures that represent some aspect of the game), the secondary or bonus stage game is played on the same game machine as the primary game, sometimes using the same screen and sometimes using a secondary screen. Other secondary games are provided as a "top box" integral with or otherwise attached to the cabinet housing the primary game 12, as shown in FIG. 1.

The primary game 12 is operably coupled for communication to the secondary game 14, such as via direct communication lines, or such as via network devices (e.g., wired or wireless network cards and cabling), or via an instrument bearing communication (e.g., tickets, magnetic-strip cards, smart cards, etc.). In FIG. 1, where the primary game is in close proximity to the secondary game, direct communication lines (not shown) are preferred, although instrument bearing communication may alternatively be used (e.g., a ticket printer 16 associated with the primary game and a ticket reader 18 associated with the secondary game). In this way, the primary game 12 is able to provide the secondary game 14 with information to enable play of the secondary game (e.g., game enablement, award amount, etc.).

In operation, as described more fully below in conjunction with FIG. 5, when a predetermined game event or win (e.g., certain game symbol(s), or a combination of game symbols) occurs on the primary game 12, the secondary game 14 is enabled for play by the player. Once enabled for play, the secondary game 14 manages the secondary award payout process in accordance with the present invention, as shown and described more fully below in conjunction with FIG. 5 through FIG. 7.

Figure 2:
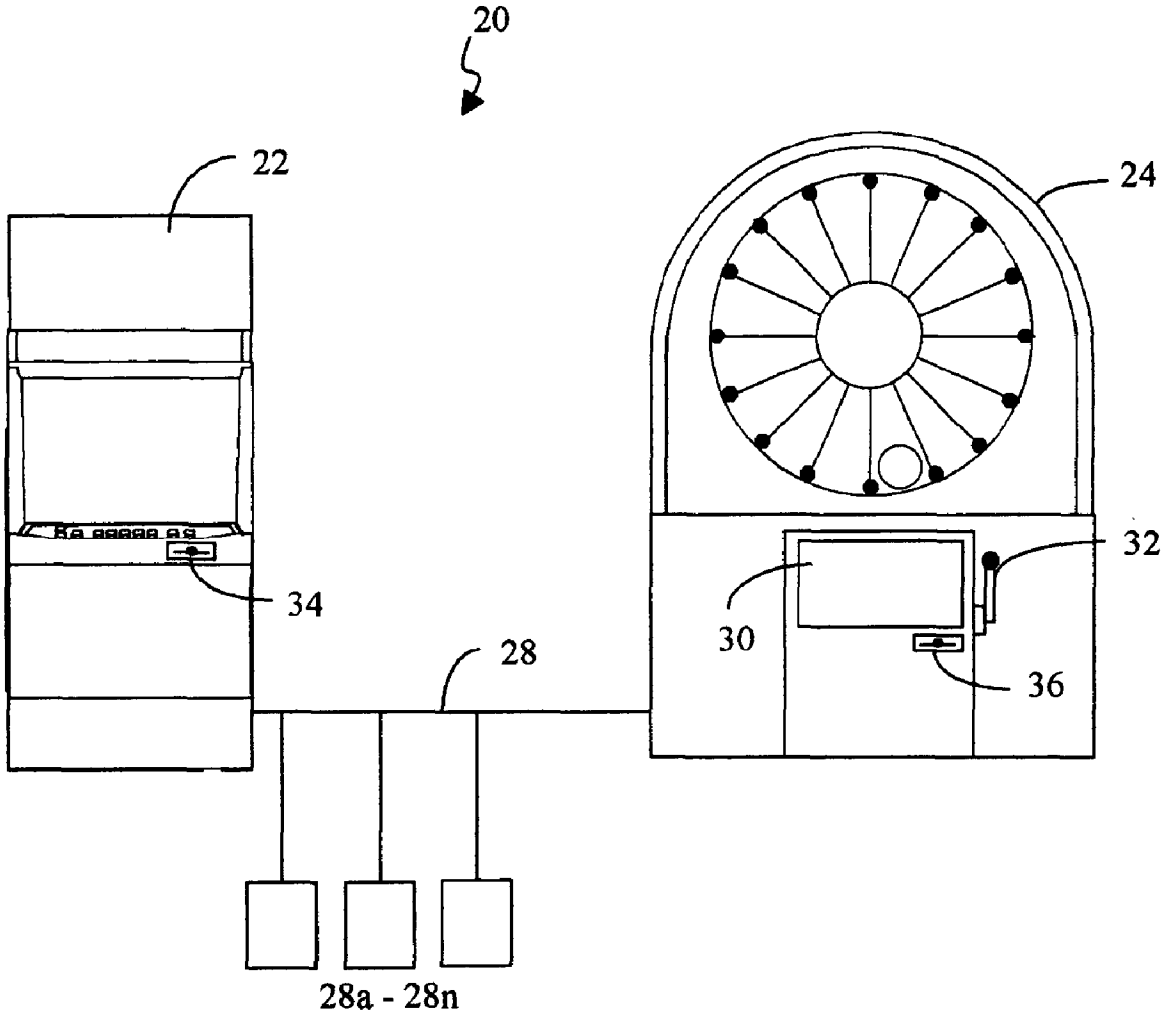
FIG. 2 illustrates an example gaming system including a primary game apparatus and a secondary game apparatus suitable for use with the present invention.

Referring next to FIG. 2, there is shown an example gaming system 20 where a primary game apparatus 22 and a secondary game apparatus 24 are not integrated into or otherwise share the same housing or cabinet unit. The primary game apparatus 22, like primary game 12, comprises a conventional game of chance, such as a slot machine, video poker machine, keno machine, video lottery terminal, bingo, or other game of chance, and thus comprises conventional hardware (e.g., processor, memory, I/O devices) and software (game software) components suitable for executing the game of chance, as described above.

The secondary game apparatus 24 is operably coupled for communication to the primary game 22, normally via a network connection 26 (e.g., Ethernet, or other wired or wireless network) or via an instrument bearing communication means (e.g., tickets, magnetic-strip cards, smart cards, etc.). For example, the primary game apparatus 22 may print a ticket via ticket printer 34 which is received and read by a ticket reader 36 of the secondary game apparatus 24. The ticket may include such information as play enablement data and award amount, for example, which may be printed in a machine readable form, such as a bar code, on the ticket. The ticket is then processed by the secondary game apparatus 24 and managed therein to provide a player with a payout in accordance with the present invention. The management of the secondary award and payout process is described in further detail below in conjunction with FIG. 6 and FIG. 7.

The secondary game apparatus 24 of FIG. 2 is a "shared-secondary bonus station" which may be shared with other primary game apparatus 28*a* through 28*n*. Like the secondary game of FIG. 1, secondary game apparatus 24 is a bonus wheel game, the details of which are described more fully below (FIG. 3 and FIG. 4). The details of a shared secondary bonus stations are described more fully in applicant's copending U.S. patent application Ser. No. 10/077,242 entitled "Shared Secondary Game Station And System" and filed on Sep. 14, 2002, the disclosure of which is incorporated herein by explicit reference. In general, the secondary game apparatus 24 according to this configuration comprises separate I/O devices (e.g., display device 30, player buttons/controls 32) from the primary game apparatus 22.

A fully contemplated embodiment of the shared secondary game is in the form of the primary games being played on PCs (where any of 22 or 28*a*-28*n* would be PC-based games), network connection 28 is an intranet or an internet connection, and secondary game 24 is at a centralized location. In one preferred embodiment, the communications would be carried using a commercially available secure layered connection such as SSL, where the secondary game triggering event would depend on the primary game (pure skill, achievement of a certain number of skill points, chance, upon the occurrence of a specified randomly generated event). Players would be charged per game play session, and would therefore need some kind of centralized accounting or credit management system (not shown). A preferred embodiment would have the secondary game generate both the potential win amount and the actual win amount (in one embodiment based on, or capped by, a player's net contributions) to preserve the integrity of the secondary game process. This leaves communication between the remote games and the centralized secondary game to secondary game play initiation and crediting activity; activities which can be carried out securely, and activities that leave the central system's integrity intact regardless of how comprised an individual PC might be.

Referring now to FIG. 3 and FIG. 4, as well as FIG. 1 and FIG. 2, the details of the example secondary bonus wheel game of FIG. 1 and FIG. 2 are more fully shown and described in further detail.

FIG. 3 illustrates a sample wheel 50 comprising a plurality of slots 54 radiating from the wheel's center axis 52. For each slot 54, there is associated an award payout which is represented by indicia 56 printed on the slot surface of the wheel 50 and visible to the player. The wheel further includes a housing or chamber (not represented in FIG. 3), made of clear material (such as glass, plexiglas, or plastic, for example) to enclose a ball indicator 60 within the interior circumference of the wheel 50. According the example embodiment of FIG. 3, barriers 62 are further provided within the wheel's chamber to further restrict the ball's 60 positional location within the wheel 50 to a predetermined number of slots, defining a slot range 64. This slot range 64 will identify a plurality of possible slots on which the ball may land, each slot (and its associated award payout) within a prescribed range as controlled by the secondary game.

Pegs 58 may also be provided on the inner surface of the circumference of wheel 50, each peg 58 located between the slots 54 to allow the ball 60 to more discretely land on a single slot 66 within the slot range 64. During operation, wheel 50 is rotated causing the ball 60 to be released from its previous position. As the wheel 50 comes to a stop, the ball 60 will come to rest on one of the slots 54 within the slot range 64. The slot on which the ball lands identifies the player's actual award payout.

The ball's position at the end of play may be ascertained electronically using conventional circuitry components. For example, passive electronic components (e.g., a capacitor) may be placed within the ball, and sensors may be used along the circumference of the wheel to detect the ball's position by querying for the appropriate signal. Other means for identifying the ball's position may also be used, and the present invention contemplates any suitable means for ball detection. For example, mechanical pressure sensors may be placed along the inner surface of the wheel circumference to identify where the ball comes to rent at the end of play. By way another illustration, optical sensors may also be used.

FIG. 4 illustrates a block diagram of a sample secondary game system 70 suitable for controlling the example wheel apparatus of FIG. 3 in accordance with the present invention. The system 70 includes a processor 72 for carrying out the secondary game instructions (generally designated secondary game manger 74) which is normally provided in a memory storage device (e.g., EEPROM, CDROM, or other memory media) which is loaded to and executed by the processor 72. The wheel assembly 50 (such as one described in FIG. 3) is driven by a wheel drive unit 76, which controls the starting and stopping of the rotation of the wheel 50, according to instructions provided by the processor 72. An example wheel drive unit 76 for this application would include a motor linked via to a drive gear which is coupled to the wheel 50. Input signals from the processor 72 provide the starting and stopping signals to the drive unit 76.

One or more rotation sensors 78 may be interfaced to the wheel assembly to determine the angular rotation of the wheel 50. Sensors used in stepping reels of conventional electromechanical slot machine perform a similar function and may be adapted for use with the present invention, although other means for determining the angular rotation of the reel are equally suitable and anticipated for use with the present invention. The angular rotation of the wheel is used by the secondary game manager 74 to determine and control which slots 54 are within the slot range 64. Although angular rotation is used herein for the example embodiment of FIG. 3 and FIG. 4, other means for determining which slots 54 are within the slot range 64 may be used, such as proximity indicators and sensors associated with corresponding slots 54, for example.

As described above, ball location sensor(s) 80 are used to identify which slot 54 the ball 60 lands in at the end of play. This information is communicated to the secondary game manager 74 for further processing in accordance with the invention.

The secondary game manager 74 comprises a payout manger 82 which manages the secondary award payout process, and a display manger 84 which manages the display mechanism (in this case wheel 50) in accordance with the secondary award payout as determined by the payout manager 82.

First, the award payout manager 82 receives a signal or other communication (enablement data) that a player is authorized to play the secondary game. As described above, this enablement data is transmitted by a primary game upon the occurrence of a qualifying event in the primary game. The enablement data may be transmitted in various ways, also as described above (e.g., direct communication, network communication, via a player-carried voucher or other instrument).

The enablement data may indicate the player award amount or value. Otherwise the payout manager 82 may establish the payout award amount. According to the preferred embodiment, the payout awarded amount establishes the maximum amount boundary to be paid out (award payout) to the player, although in alternative embodiments other parameters may be specified by the payout award amount (e.g., a minimum and maximum to be paid out).

The player award amount is communicated to the display manger 84 which activates the wheel 50. The wheel 50 is controlled so that when stopped, the slot range 64 includes payout values which are less than or equal to the player award amount. Since the slot range 64 includes a plurality of possible payouts, depending on where the ball 60 lands, the actual player payout as indicated by the ball 60 may differ from the player award amount (e.g., may be less than the player award amount). As noted above, this arrangement provides increased flexibility and enhanced game play for players of secondary or bonus stage games, thereby fostering increased game play and revenue for the game operator.

The player is awarded the player payout indicated by the ball 60 by the payout manager 82. The payouts awards may take various forms, such as credit awards, currency award, tangible prizes awards, or vouchers for prizes, among others. As described more fully below, the difference between the actual payout amount and the player payout may be managed in any number of ways (FIG. 7).

Figure 8:
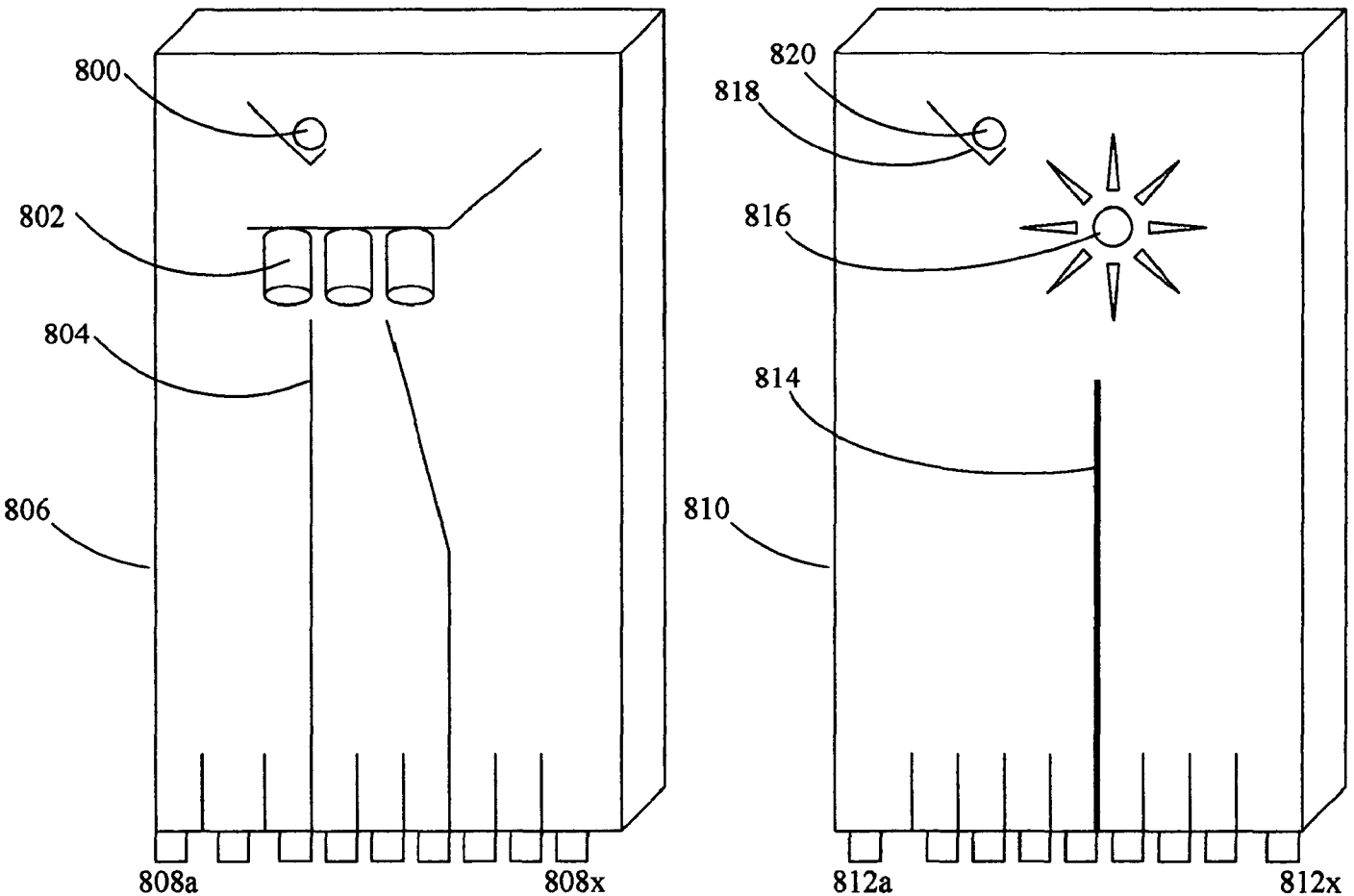
FIG. 8 is a block diagram of secondary games according to the present invention.

FIG. 8 illustrates several more secondary games having at least some mechanical components (which increase a player's perception of true randomness, because they can see something happening such as a ball fall that is not in the control of something they can't see, such as game software). Secondary games 806 and 810 each have a ball (800, 820) and some kind of release mechanism 818. The release mechanism may be an active lever, allowing a player to "place" the ball in a manner similar to the flipper levers in a pin-ball machine, or, may be passive in that all a player can do is simply release the ball to fall. Game 806 is intended to have an active ball release, with the player aiming for one of the plurality of openings 802. As soon as the game detects the ball passing through one of the slot apertures (using any well known detector such as an optical sensor, not shown), it will be known which set of award indicators 808*a*-808*x* will be used. Award indicators 808*a*-808*x* are active displays, typically LEDs, and will now be assigned multiplier numbers or award amount numbers while the ball is still descending through apertures 802. Since the game has detected which set of slots the ball will land, a series of award numbers (or award multipliers) is generated that are equal to or less than the predetermined award amount (alternatively, between a selected low and high payout amount). Those numbers are now displayed on the applicable LEDs. The game developers may choose to leave the other slot numbers blank, or fill them in with randomly selected numbers. In one preferred embodiment, at least set of slots not used for this game play will show a selection of awards that are all less than the award amounts shown in the selected slot set. This helps create the feeling in a player that "they could have done worse" and will be pleased with their use of the release lever (creates the impression of player involvement, to the player's emotional benefit). The ball now exits one of aperture 802 and bounces around inside the chamber corresponding to that aperture, finally coming to rest in one of the slots inside that chamber. A ball detector means (simple mechanical spring switch, opto-sensor, capacitor based sensors, etc.) sends a signal to the secondary game controller, which awards the player the final amount won. Note that the final selection is truly dependent on "how the ball bounces" and is not under the control of the game device. This embodies what is believed to be one positive effect enabled through the use of the present invention—the appearance of a random event visible to a player and not controlled by the game device.

Game device 810 is similar to game device 806, except that the pay-out indicators 812*a*-812*x* are fixed. The game device includes at least one divider 814 that confines a falling ball to fall into one of the bottom slots inside the physical bounds of the divider(s) and side(s) of the game device. Spinning star 816 has spokes large enough to capture ball 802 when it is dropped from level 818 and deliver ball 820 to one section of the plurality of sections defined by the sides of the game and internal dividers. In this case, the predetermined award amount will determine which game section the ball is delivered to, such that the awards winnable by a player are all equal to or less than (alternatively, between a low and high payout amount) the fixed award amounts shown at the bottom of each slot. The ball bounces around inside the section until coming to rest in a slot, and the player is awarded that amount. In this embodiment, the game controls the slot in which the ball falls using star 816.

Figure 6:
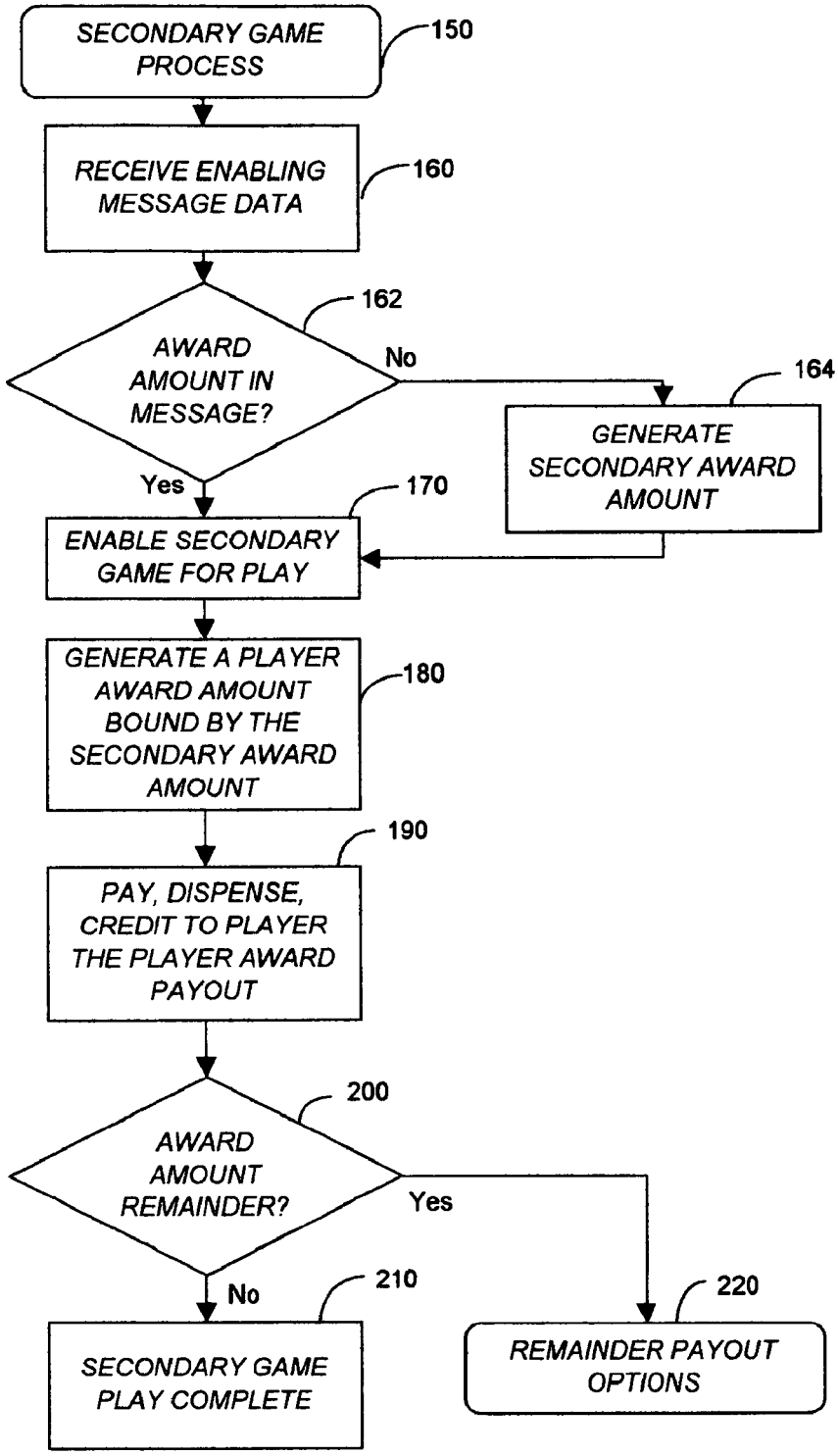
FIG. 6 is a logical flow diagram of the operation of the secondary game in accordance with the present invention.

The method and operation of the invention will be more fully understood with reference to the logical flow diagrams of FIG. 5 through FIG. 7, as well as FIG. 1 through FIG. 4. The order of actions as shown in FIG. 5 through FIG. 7 and described below is only illustrative, and should not be considered limiting.

Referring now to FIG. 5, shown is a logical flow diagram of the operation of the primary game in accordance with the present invention. The primary game may be any game of chance or gaming terminal that produces a game event qualifying the player to play a secondary or bonus round (i.e., secondary award event).

First at block 100, game play is initiated on the primary game. This process is normally carried out when a player places a wager and initiates play by pressing a play button, activating a play handle, or starting a keno or bingo game using a card purchased for this game session.

At decision block 110 and during the course of play of the primary game, one or more game events occur. If a secondary award event occurs, the "Yes" exit is taken and the actions corresponding to block 140 are then carried out. Otherwise the "No" exit is taken and the actions corresponding to block 120 are carried out. As described above, the secondary award event may be any predetermined game event during the play of the primary game (e.g., a qualifying symbol or combination of symbols). The secondary award event defines the qualifying event entitling the player to play secondary or bonus round of play on the secondary game.

The typical play will not invoke a bonus game play event, resulting in the "No" exit being taken to block 120. Actions corresponding to block 120 are those normally associated with continued game play for the primary game. Continued play results in a small loop comprising diamond 110-block 120-diamond 110 block 120 until the player wins a secondary bonus game or stops playing (see block 130). Block 130 is carried out when the primary game is completed and the player terminates game play on the primary game.

At block 140, a qualifying secondary award event has occurred, entitled the player to play the secondary or bonus round of play. In response to this event, the primary game communicates a message (i.e., sends enabling data) to the secondary game to enable play of the secondary game. As described above, this message may be communicated in several ways including direct communication, network communication, and via player-carried instrument devices.

Continuing with diamond 142, a branch occurs depending on which device (primary or secondary game device) makes the initial determination of the award amount (the predetermined award amount). If the primary game determines the secondary award amount, the "Yes" exit is taken to block 144. The actions corresponding to block 144 are that the predetermined amount is sent with the enabling message. Flow continues into block 150.

If the predetermined award amount is not determined by the primary game device, then the "No" exit is taken from diamond 142 to block 150. This corresponds to an award amount not being sent to the secondary game device in the enabling message or communications. Continuing with block 150, the secondary game process is carried out. This process is described in conjunction with FIG. 6 below.

Referring now to FIG. 6, there is shown a logical flow diagram of the operation of the secondary game in accordance with the present invention. This process begins with block 150 and is carried out subsequent to block 140 of FIG. 5

At block 160, the secondary game receives the enabling message data generated by the primary game. This message may be received in several ways including direct communication, network communication, and via player-carried instrument devices, for example. Flow then continues to diamond 162. The actions and decisions corresponding to diamond 162 are to note if an award amount has been sent with the enabling message. If not, the "No" exit is taken to block 164. The actions corresponding to block 164 are to generate the predetermined award amount in the secondary game or bonus game. Flow then continues to block 170. Returning to diamond 162, if an award amount is included in the enabling message data, then the "Yes" exit is taken to block 170 directly.

Next at block 170, the secondary game is enabled for play. For example, the play button or handle may be enabled for the player. After the player initiates play, block 180 is then carried out.

At block 180, the secondary game generates a secondary player award payout which is bound by the secondary award amount from diamond 162 or block 164. Referring to the example secondary wheel game of FIG. 1 through FIG. 4, the wheel 50 is spun and caused to stop so that the slot range 64 is limited to slots which have associated payouts less than or equal to the secondary award amount of block 164 or diamond 162. The actual player payout is determined by a second random event, which in the present example is a random selection of one of the slots in slot range 64 by a ball. The ball 60 will come to rest on one of the slots within the slot range 64, and will define the player's secondary award payout.

Next at block 190 the secondary game awards to the player the determined payout of block 180. Various well known means in the art for awarding such payouts may be carried out pursuant to this award event (e.g., currency dispensers, electronic account transfer devices (EFTs), prize dispensers, vouchers for prizes printed by a printer, etc.).

Next at decision block 200, the secondary game ascertains whether an award payout remainder exists. The award payout remainder is the difference between the secondary award amount (of block 160) and the actual player award payout (of block 180). If the actual player award payout is the same as the secondary award amount, no remainder exists and block 210 is carried to terminate play of the secondary game. Otherwise, a remainder exists and process 220 is then carried out. Process 220 describes various options for managing the remainder value and is described in detail in conjunction with FIG. 7 below.

Referring now to FIG. 7, there is shown a logical flow diagram of the remainder payout options in accordance with the present invention. This process begins with block 220, which follows decision block 200 of FIG. 6.

According to one option, depicted in block 230, the remainder value is accumulated to a progressive meter and paid in conjunction with a progressive jackpot pursuant to a qualifying progressive payout event. The qualifying progressive payout event may be defined pursuant to play on a primary game and/or secondary game.

According to another option, depicted in block 240, the remainder value is reserved and added to future plays (or the next play) of the secondary game. For example, the remainder value may be paid in addition to the normal award payout during the next play of the secondary game.

According to another option, depicted in block 250, the remainder value is paid pursuant to a "simulated" bonus award in the secondary game. For example, the bonus wheel may include a "bonus payout" indicator supplementing the player's winnings. This "bonus payout" which is the remainder value is paid to the player in addition to the actual player payout. A preferred embodiment of this option is to have a portion of the game's main screen, or a secondary screen, have a visually obvious box portion with a label indicating it is the "bonus payout" amount, which would initially show as 0 credits. After the secondary bonus is finished, the "bonus payout" box would flash or otherwise indicate usage, with the amount credits shown in the box being the remainder between the predetermined award amount and the actual award amount.

According to yet another option, depicted in block 260, the remainder value is paid pursuant to multiple plays of the secondary game, where play of the secondary game is reenabled for play (the remainder value defining the range of the next payout), until the remainder value is zero (exhausted).

Various other strategies may further be used to manage payout of the remainder value. Although the description above contains many specificities, these should not be construed as limiting the scope of the invention but as merely providing an illustration of the presently preferred embodiment of the invention.

What is claimed:

1. A method for operating a primary game and a secondary game stored in a memory of a gaming machine having a processor, the method comprising the steps of:

under control of the processor, generating a maximum secondary game award amount;

enabling the secondary game for play;

generating a player award amount wherein the player award amount does not exceed the maximum secondary game award amount;

paying the player award amount to a player; and adding any difference between the maximum secondary game award amount and the player award amount to a progressive jackpot meter.

2. The method of claim 1, wherein the maximum secondary game award amount is generated by the primary game.

3. The method of claim 1, wherein the maximum secondary game award amount is generated by the secondary game.

4. A method for operating a primary game and a secondary game stored in a memory of a gaming machine having a processor, the method comprising the steps of:

under control of the processor, generating a maximum secondary game award amount;

enabling the secondary game for play;

generating a player award amount wherein the player award amount does not exceed the maximum secondary game award amount;

paying the player award amount to a player; and reserving any difference between the maximum secondary game award amount and the player award amount for addition to a future secondary game award.

5. The method of claim 4, wherein the maximum secondary game award amount is generated by the primary game.

6. The method of claim 4, wherein the maximum secondary game award amount is generated by the secondary game.

7. A method for operating a primary game and a secondary game stored in a memory of a gaming machine having a processor, the method comprising the steps of:

under control of the processor, generating a maximum secondary game award amount;

enabling the secondary game for play;

generating a player award amount wherein the player award amount does not exceed the maximum secondary game award amount;

paying the player award amount to a player; and simulating a bonus award in the secondary game, the bonus award amount comprising any difference between the maximum secondary game award amount and the player award amount.

8. The method of claim 7, wherein the maximum secondary game award amount is generated by the primary game.

9. The method of claim 7, wherein the maximum secondary game award amount is generated by the secondary game.

10. A method for operating a primary game and a secondary game stored in a memory of a gaming machine having a processor, the method comprising the steps of:

under control of the processor, generating a maximum secondary game award amount;

enabling the secondary game for play;

generating a player award amount wherein the player award amount does not exceed the maximum secondary game award amount;

paying the player award amount to a player; and enabling one or more additional plays of the secondary game until any difference between the maximum secondary game award amount and the player award amount has been paid to the player.

11. The method of claim 10, wherein the maximum secondary game award amount is generated by the primary game.

12. The method of claim 10, wherein the maximum secondary game award amount is generated by the secondary game.

* * * * *